US006071198A

United States Patent [19]

Nishizawa et al.

[11] Patent Number: 6,071,198

[45] Date of Patent: Jun. 6, 2000

[54] IRON GOLF CLUB SET

[75] Inventors: Yoh Nishizawa; Masahiko Miyamoto, both of Hiratsuka, Japan

[73] Assignee: The Yokohama Rubber Co., Ltd., Tokyo, Japan

[21] Appl. No.: 09/136,417

[22] Filed: Aug. 19, 1998

[30] Foreign Application Priority Data

Sep. 9, 1997 [JP] Japan ..... 9-244010

[51] Int. Cl.[7] ..... A63B 53/04

[52] U.S. Cl. ..... 473/291; 473/349

[58] Field of Search ..... 473/287–292, 473/349

[56] References Cited

U.S. PATENT DOCUMENTS 4,128,242 12/1978 Elkins ..... 473/291

5,228,688 7/1993 Davis ..... 473/290

5,318,296 6/1994 Adams ..... 473/291

5,429,353 7/1995 Hoeflich ..... 473/350

5,823,887 10/1998 Mikame ..... 473/290

*Primary Examiner*—Jeanette Chapman

*Assistant Examiner*—Stephen L. Blau

*Attorney, Agent, or Firm*—Finnegan, Henderson, Farabow, Garrett & Dunner, L.L.P.

[57] ABSTRACT

In an iron golf club set including at least seven iron golf clubs of the third to ninth club numbers, each moment (Mx(gf·mm)=W×cos θ×L) of each club of the iron golf clubs is set at a range within ±3% of the average value Mxm of the moments of the club heads, where W(gf) is a head weight of each of the iron golf clubs, L(mm) is a distance of a center of gravity of a head from the shaft axis line along a line normal to the shaft axis line, and θ (°) is a lie angle of each club.

3 Claims, 2 Drawing Sheets

IRON GOLF CLUB SET

BACKGROUND OF THE INVENTION

The present invention relates to an iron golf club set, more particularly to an iron golf club set by which a golfer can fly each ball to the same direction by approximately the same head turn of each club in hitting when the golfer swings in the same manner with regard to at least seven iron golf clubs of the third to ninth numbers.

Generally, since an iron golf club is a club mainly for getting an accurate flying distance, with regard to golf club numbers, the third to ninth number irons, pitching wedge (PW), sand wedge (SW) and the like which can easily fly up a ball into the air and lessen the run, are employed among club counts in many cases.

Among iron golf clubs, while the club of the third to ninth numbers are often used to hit a ball by full swing, the PW, SW and the like are used to hit in a short distance within about 100 yards more accurately. Therefore, a golfer sometimes controls a shot adjusting the swing power. Accordingly, while the flying distance by the wedge depends on a golfer's skill, the shot ball direction and its flying distance by iron golf clubs of the third to ninth numbers by which a ball is hit by full swing are apt to depend on the efficiency of a golf club itself.

However, in the conventional iron golf club set, a ball tends to easily slice since in the case of a long iron the head turn is late at the impact and easily becomes the state that the face is open even if a golfer swings in the same fixed condition. Conversely, since in the case of a short iron the head turn is early and easily becomes the state that the iron face is closed, the shot ball tends to easily hook.

As a countermeasure for above-described condition, conventionally, there is, for example, a proposition that the condition of head turn should be constant by making the moment My (the head weight×the distance of the center of gravity) of club head around shaft axis line of each iron golf club equal respectively (for example, Japanese Patent Laid-Open 54-22241). However, since the head of golf club has a different lie angle in each number, even if the moment My defined by the head weight×the distance of the center of gravity is made to be equal with regard to each club, the condition of face turn of head cannot be necessarily fixed as to each club and it was not an essential solution.

SUMMARY OF THE INVENTION

The object of the present invention is to provide an iron golf club set by which it is possible that the head turn of each club is approximately fixed if a golfer swings in the same manner in a golf club set including at least seven iron golf clubs of the third to ninth numbers.

The present invention to achieve the above-described object is characterized in that in an iron golf club set including at least seven iron golf clubs of the third to ninth numbers that the larger the club number is, the shorter the shaft length is and the larger the lie angle is, each of moments (Mx(gf·mm)=W×cos θ×L) of club heads around the shaft axis lines of the iron golf clubs is set to be larger than the average value Mxm of the moments of the club heads within ±3% of that average value when the head weight of the foregoing each iron golf club is regarded as W(gf), the distance of the center of gravity measured perpendicularly to the shaft axis line from the center of gravity of head G is regarded as L(mm) and the foregoing lie angle is regarded as θ (°).

As described above, the moment of the club head around the shaft axis line is approximately fixed as long as a golfer swings in the same manner and the head turn can be approximately fixed in all clubs of third to ninth by that the moment is specified like the foregoing formula in relation to lie angle and the value is set to be larger than the average value of all iron golf clubs of third to ninth within ±3% of that average value.

BRIEF DESCRIPTION OF THE DRAWINGS

For a more complete understanding of the present invention and advantages thereof, reference is now made to the following description taken in conjunction with the accompanying drawings, in which.

DETAILED DESCRIPTION OF THE PREFERRED EMBODIMENTS

Figure 1:
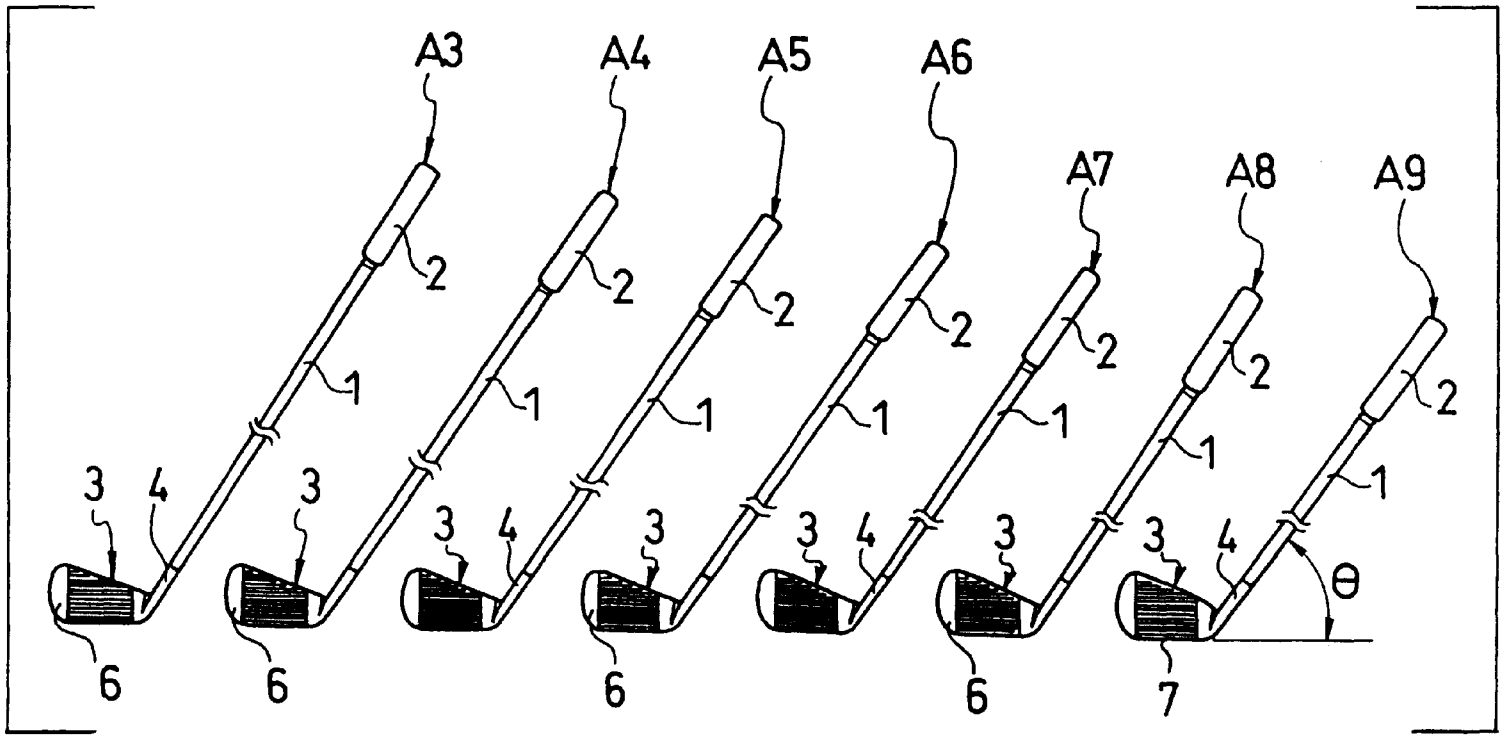
FIG. 1 is a front view showing an example of an iron golf set of the present invention in which a part of a club shaft is omitted.

FIG. 1 shows an example of an iron golf club set of the present invention. This golf club set is composed of a series of 7 golf clubs from the third iron club A3 to the ninth iron club A9. Each golf club is constituted such that the grip 2 is provided in the uppermost end of the club shaft 1 and the club head 3 is provided in the lowermost end thereof. The club shaft 1 is connected to the hosel 4 projecting upward on a heel side of the club head 3.

These iron golf clubs A3 to A9 are designed such that a loft angle of the plane-shaped face 6 formed on the front surface of the club head 3 becomes larger at the substantially constant rate as the club number becomes larger. Moreover, while a shaft length from the uppermost end of the grip 2 to the lowermost end of the club head 3 becomes shorter gradually as the club number becomes larger, a lie angle θ (degree) defined in terms of an inclination angle for the horizontal plane of the club shaft 1 at the time when the sole 7 is set horizontally becomes larger approximately at a constant rate within a range of $59.5° \leqq \theta \leqq 62.5°$ as the club number becomes larger.

Figure 2:
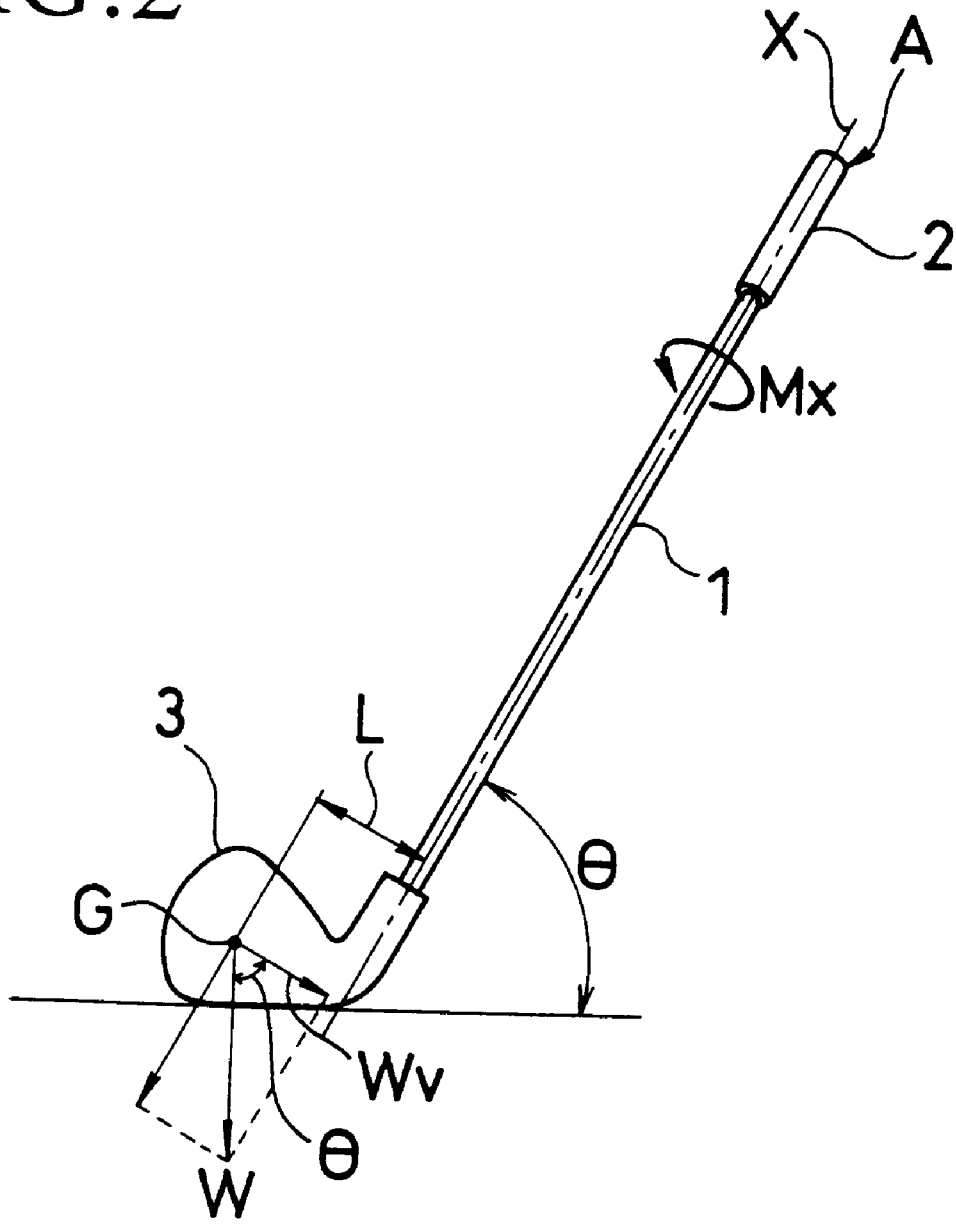
FIG. 2 is an explanatory view showing a moment of club head around a shaft axis line in the present invention.

In the present invention, as shown in FIG. 2, in the case of the iron golf club A, a head weight of the club head 3 is denoted as W(gf); and a distance of a center of gravity obtained by measuring normal to the shaft axis line X of the club shaft 1 from a center of gravity G of the head, which is a distance from the shaft axis line X of the club shaft 1 to the center of gravity G is denoted as L(mm). When the moment Mx(gf·mm) of each club head 3 around the shaft axis line is defined by the following formula including the relation with the above-described lie angle θ, values of the moments Mx of the club heads 3 to 9 are set within a range of ±3% of the average value Mxm of the moments of the club heads and the value of the moment Mx is set to be approximately the same as the average value Mxm.

$$Mx = W \times \cos\theta \times L$$

When the moment Mx of club head around the shaft axis line of each of iron golf clubs of third to ninth numbers in the address state is outside of the range of ±3% of the average value Mxm, a golfer will only be able to swing under the same manner with each of iron golf clubs and maintain constantly the same flying direction of ball with difficulty. Because the golfer becomes to feel somewhat different sense respectively on shooting a ball with each iron golf club for the reason of arising some different feeling at the time of turning the club head on shooting the ball.

The inventors of the present invention earnestly studied the fact that it is impossible to make the head turn constant only by making the moment My constant defined by a center of gravity×a distance of a center of gravity (W×L) even when the golfer swings all of the iron golf clubs in the same manner. As a result of this study, it is proved that the inclination of the shaft is different depending on each number at the time of the address state when he shots the golf ball, in other words, influences of the lie angle θ are not considered.

Specifically, the moment Mx of the club head around the shaft axis line in the address state is equal to the product of the head weight component Wv and the distance of a center of gravity L, which is perpendicular to the shaft axis as shown in FIG. 2. This head weight component Wv is the product W×cos θ of the head weight W and the cosine of the lie angle θ. Therefore, it is difficult to make the head turns equal, even when the moment My expressed simply by W×L is made to be equal for each iron golf club without consideration for the inclination of the lie angle θ as conventional. As a result, by making the moment Mx, which is defined taking the inclination of the lie angle θ into consideration approximately, equal among clubs of the iron golf club set, it becomes possible to make the head turns approximately equal when the golfer swings the iron clubs in the same manner. As a result, the golfer can always make a stable shot in which the golf ball flies into a certain direction.

The iron golf club set of the present invention includes at least seven iron golf clubs of the third to ninth numbers. However, as a matter of course, the iron golf club set of the present invention may include iron golf clubs of the first and second numbers, or iron golf clubs such as a pitching wedge and a sand wedge. Even when the iron golf club set is composed of iron golf clubs more than eight, the iron golf club set of the present invention is satisfactory as long as the iron golf clubs of the third to ninth numbers are designed as described above.

EXAMPLE

With regard to the iron golf club set composed of the seven iron golf clubs of the third to ninth numbers shown in FIG. 1, the iron golf club set of the present invention was prepared as a set for testing, in which the moment Mx of the head around the shaft axis line including the relation with the lie angle θ is made to be larger than the average value of the total clubs within the range of ±3% of the average value of the total clubs. The conventional set 1 in which the moment is not considered was prepared as another set for testing. The conventional set 2 in which the moment My=W×L of the head around the shaft axis line is simply made approximately equal among the clubs without consideration of the lie angle θ was prepared as still another set for testing.

In each set for testing, the lie angle θ and the head weight of each club number are made common as shown in Table 1. By changing the distance of a center of gravity in the set of the present invention and the conventional set 2, the moments Mx and My (gf·mm ) of the heads around the shaft axis lines are adjusted as shown in Table 1.

As to these sets, the actual shot test were carried out under the measurement conditions as described below and the following results shown in Table 2 were obtained.

Shot Tests

The actual shot tests were carried out by four middle class amateur golfers a, b, c, d and e. Whether approximately the same flying trajectory of the golf ball is obtained or not was evaluated when they perform the swings for the clubs in the same manner. The evaluation results are illustrated by the symbol ○ (good ) and the symbol × (bad).

TABLE 1

| | set of the present invention (gf · mm) | | conventional set 1 (gf · mm) | | Conventional set 2 (gf · mm) | |
|---|---|---|---|---|---|---|
| club count | W × cos θ × L | W × L | W × cos θ × L | W × L | W × cos θ × L | W × L |
| #3 | 4750.0 | 9350.5 | 4519.7 | 8905.2 | 5019.1 | 9889.2 |
| #4 | 4746.4 | 9492.8 | 4573.8 | 9147.6 | 4939.2 | 9878.4 |
| #5 | 4742.0 | 9638.2 | 4583.5 | 9308.0 | 4865.1 | 9880.2 |
| #6 | 4748.2 | 9790.0 | 4794.4 | 9889.2 | 4794.4 | 9889.2 |
| #7 | 4744.3 | 9946.2 | 4745.9 | 9946.2 | 4716.8 | 9891.4 |
| #8 | 4741.8 | 10110.4 | 4815.1 | 10256.5 | 4643.6 | 9901.5 |
| #9 | 4748.2 | 10277.5 | 4929.8 | 10676.4 | 4572.0 | 9901.5 |
| average value | 4745.8 | 9800.8 | 4708.9 | 9732.7 | 4793.3 | 9888.7 |
| Range (±%) | 0.09 | 4.73 | 4.35 | 9.10 | 4.66 | 0.12 |
| MAX | 4750.0 | 10277.5 | 10676.4 | 5019.12 | 9901.5 | |
| MIN | 4741.8 | 9350.5 | 4519.7 | 8905.2 | 4572.0 | 9878.4 |

| | lie | | | L (distance of center of gravity (mm)) | | |
|---|---|---|---|---|---|---|
| club count | angle θ (°) | cosθ | head weight W(g) | set of the present invention | conventional set 1 | conventional set 2 |
| #3 | 59.5 | 0.508 | 246.0 | 38.04 | 36.20 | 40.20 |
| #4 | 60.0 | 0.500 | 252.0 | 37.67 | 36.30 | 39.20 |
| #5 | 60.5 | 0.492 | 260.0 | 37.04 | 35.80 | 38.00 |
| #6 | 61.0 | 0.485 | 268.0 | 36.54 | 36.90 | 36.90 |
| #7 | 61.5 | 0.477 | 274.0 | 36.29 | 36.30 | 36.10 |
| #8 | 62.0 | 0.469 | 281.0 | 35.94 | 36.50 | 35.20 |
| #9 | 62.5 | 0.462 | 287.0 | 35.83 | 37.20 | 34.50 |

TABLE 2

| | a | b | c | d | e |
|---|---|---|---|---|---|
| set of the present invention | ○ | ○ | ○ | ○ | ○ |
| conventional set 1 | X | X | X | X | X |
| conventional set 2 | X | X | X | X | X |

As is clear from Table 2, the iron golf club set of the present invention can obtain approximately the constant flying trajectory of the golf ball. It is found that the head turn can be made approximately constant if the golfer swings the club in the same manner.

As described above, in the iron golf club set including at least seven iron golf clubs of the third to ninth numbers, the present invention specifies the moment of the head around the shaft axis line in relation to the lie angle and makes the moment in each iron golf club approximately equal. If the golfer swings the iron golf club in the same manner, the head turn of the head of each iron golf club can be made approximately constant.

Although the preferred embodiment of the present invention has been described in detail, it should be understood that various changes, substitutions and alternations can be made therein without departing from spirit and scope of the inventions defined by the appended claims.

What is claimed is:

1. An iron golf club set comprising:

at least seven iron golf clubs of the third to ninth club numbers in which a length of a shaft becomes shorter and a lie angle becomes larger as the club number becomes larger, wherein each moment ($Mx(gf \cdot mm)=W \times \cos\theta \times L$) of each club head around a shaft axis line of said iron golf clubs is set at a range within ±3% of the average value Mxm of the moments of the club heads, where W(gf) is a head weight of each of said iron golf clubs, L(mm) is a distance of a center of gravity of a head from the shaft axis line along a line normal to the shaft axis line, and θ (°) is said lie angle.

2. The iron golf club set according to claim 1, wherein said lie angle θ (°) is within a range of $59.5° \leqq \theta \leqq 62.5°$.

3. The iron golf club set according to claim 1, wherein said club number includes a pitching wedge and a sand wedge in addition to the seven iron golf clubs of the third to ninth club numbers.

* * * * *